US006507237B2

(12) United States Patent
Hsu et al.

(10) Patent No.: US 6,507,237 B2
(45) Date of Patent: Jan. 14, 2003

(54) LOW-POWER DC VOLTAGE GENERATOR SYSTEM

(75) Inventors: Louis L. Hsu, Fishkill, NY (US); Rajiv V. Joshi, Yorktown Heights, NY (US); Russell J. Houghton, Essex Junction, VT (US); Wayne F. Ellis, Jericho, VT (US); Jeffrey H. Dreibelbis, Williston, VT (US)

(73) Assignee: IBM Corporation, Armonk, NY (US)

( * ) Notice: Subject to any disclaimer, the term of this patent is extended or adjusted under 35 U.S.C. 154(b) by 0 days.

(21) Appl. No.: 10/039,874

(22) Filed: Jan. 3, 2002

(65) Prior Publication Data

US 2002/0057126 A1 May 16, 2002

Related U.S. Application Data

(62) Division of application No. 09/627,599, filed on Jul. 28, 2000, now Pat. No. 6,337,595.

(51) Int. Cl.[7] ..... G05F 1/10

(52) U.S. Cl. ..... 327/538; 327/536; 327/537; 323/313; 363/59

(58) Field of Search ..... 327/530, 531, 327/533, 534–538, 540, 545; 323/313–316; 363/59, 60; 307/110

(56) References Cited

U.S. PATENT DOCUMENTS 4,839,787 A * 6/1989 Kojima et al. ..... 363/60
5,008,799 A * 4/1991 Montalvo ..... 363/60
5,301,097 A * 4/1994 McDaniel ..... 363/60
5,388,084 A * 2/1995 Itoh et al. ..... 327/540
5,412,257 A * 5/1995 Cordoba et al. ..... 327/536
5,553,295 A * 9/1996 Pantelakis et al. ..... 395/750
5,602,794 A * 2/1997 Javanifard et al. ..... 365/226
6,052,022 A * 4/2000 Lee ..... 327/536

* cited by examiner

*Primary Examiner*—Timothy P. Callahan
*Assistant Examiner*—An T. Luu
(74) *Attorney, Agent, or Firm*—Dilworth & Barrese, LLP

(57) ABSTRACT

A low-voltage, low-power DC voltage generator system is provided having two negative voltage pump circuits for generating voltages for operating negative wordline and substrate bias charge pump circuits, a reference generator for generating a reference voltage, and a two-stage cascaded positive pump system having a first stage pump circuit and a second stage pump circuit. The first stage converts a supply voltage to a higher voltage level, e.g., one volt to 1.5 volts, to be used for I/O drivers, and the second stage converts the output voltage from the first stage to a higher voltage level, e.g., from 1.5 volts to about 2.5 volts, for operating a boost wordline charge pump circuit. The DC voltage generator system further includes a micro pump circuit for providing a voltage level which is greater than one-volt to be used as reference voltages, even when an operating voltage of the DC voltage generator system is at or near one-volt. A one-volt negative voltage pump circuit is also included for pumping the voltages of at least one corresponding charge pump circuit, even when an operating voltage of the DC generator system is at or near one-volt. The DC voltage generator system is specifically designed to be implemented within battery-operated devices having at least one memory unit. The low-power consumption feature of the DC voltage generator system extends battery lifetime and data retention time of the cells of the at least one memory unit.

26 Claims, 5 Drawing Sheets

LOW-POWER DC VOLTAGE GENERATOR SYSTEM

This application is a divisional of Ser. No. 09/627,599 filed on Jul. 28, 2000 and now becomes U.S. Pat. No. 6,337,595.

FIELD OF THE INVENTION

This invention relates to the field of integrated circuit (IC) design. Specifically, it relates to a low-voltage, low-power DC generator system for a semiconductor chip.

BACKGROUND OF THE INVENTION

Semiconductor memory units embedded within an integrated circuit (IC) system are arranged in arrays of cells, where each cell stores one bit of information (1 or 0). Generally, in order to maintain the integrity of the data stored within an embedded semiconductor memory unit, such as an embedded dynamic random access memory unit (eDRAM), each cell of the memory unit requires periodic refreshing, since a small charge stored in each cell of the memory unit tends to leak off due to several factors, such as an increase in the temperature of the chip. Accordingly, circuitry is required to manage or control such semiconductor memory units for refreshing the cells, as well as read or write data from or to the memory array. Hence, these circuits consume power causing a reduction in the lifetime of the battery when these circuits are utilized in hand-held, battery-operated devices.

The refresh read or write circuitry generally includes at least one DC voltage generator system having several charge pump circuits for providing different voltage and current supplies to cells and other circuits of the memory unit. For example, three typical charge pump circuits for the eDRAM are the substrate bias circuit or Vbb charge pump circuit, the negative wordline low bias circuit or Vwl charge pump circuit, and the boost wordline high voltage circuit or Vpp charge pump circuit. A respective constant-speed ring oscillator provided in proximity or within the memory unit is generally used to run each of these charge pump circuits. A typical frequency range for the oscillator is from 5 MHZ to 50 MHZ depending on the voltage or current required to be produced by the particular charge pump circuit.

For example, for the Vbb charge pump circuit, the required capacity is low, and therefore, a 5 MHZ oscillator is sufficient. On the other hand, for the Vwl charge pump circuit, which is designed to sink large amount of current during an active mode, a 40 MHZ oscillator is required. However, during a standby or sleep mode, when there is no access to the word-lines, a lower capacity standby charge circuit supported by a lower-speed oscillator is needed for the Vwl charge pump circuit to save power. Therefore, two oscillator circuits with different capacities are needed for the Vwl charge pump circuit, i.e., one for each mode.

Further, when the supply or operating voltage, i.e, Vdd, of the memory unit starts to drop, e.g., when power output from a battery decreases, the charge produced by the charge pump circuits is affected. For example, if the peak current provided by the Vpp charge pump circuit is 4 mA when Vdd is 1.8V, when the Vdd drops from 1.8V to 1.5V and lower, the peak current provided by the Vpp charge pump circuit is much less than 4 mA. This results in performance degradation of the memory unit which could lead to data corruption or loss, since the cells of the memory unit would not be adequately restored or refreshed.

Therefore, in order to efficiently operate the charge pump circuits, the voltage provided to the charge pump circuits must be kept at a high level, i.e., prevented from dropping to a lower level. This condition necessitates that the period of time between activation of the DC voltage generator system be decreased to prevent the voltage provided to the charge pump circuits from dropping. This results in a great amount of power to be consumed by the DC voltage generator system, especially since the DC voltage generator system is operated at a high voltage. The high power consumption of the DC voltage generator system can significantly reduce battery lifetime.

Additionally, the high consumption of power by the DC voltage generator system causes the chip temperature to increase, thereby further necessitating a further decrease in the period of time between activation of the DC voltage generator system and refresh cycles of the charge pump circuits. This further causes a reduction in the battery lifetime.

As a consequence of the DC voltage generator system consuming a relatively large amount of power, memory units are generally designed with a few or no additional circuits for adding additional features to the memory unit, such as band-gap reference circuit for providing a band-gap reference voltage, and a temperature sensor circuit for approximating the chip temperature. Further, when these additional circuits are added to the memory unit, they not only consume a great amount of power, but, as a consequence of consuming a great amount of power, they further facilitate the increase in the chip temperature. As indicated above, an increase in the chip temperature causes a decrease in the period of time between activation of the DC voltage generator system and refresh cycles of the charge pump circuits, thereby draining the battery at a more rapid rate.

Additionally, the DC voltage generator system is designed to be operated at a high supply voltage because the threshold voltage of the charge pump circuits cannot be scaled in a same rate as the supply voltage. That is, if the supply voltage is at or near one-volt scaled from a high voltage level, the threshold voltage of the charge pump circuits cannot be scaled at the same rate as the supply voltage to reach the appropriate threshold voltage level. If the threshold voltage of the charge pump circuits is scaled at the same rate as the supply voltage, the DC current at standby will be out of control. As a result, if the supply voltage is dropped to at or near one-volt, the operating efficiency of the charge pump circuits is greatly degraded, because the threshold voltage of the charge pump circuits cannot be scaled at the same rate as the supply voltage.

The prior art, in the field of low-power logic applications, teaches adding at least one intermediate device having a variable threshold voltage between two logic circuits which require their operating voltages to be scaled. However, the prior art does not teach scaling the supply voltage of a DC voltage generator system with the threshold voltage of at least one charge pump circuit therein, and especially, when the supply voltage of the DC voltage generator system is at or near one-volt.

The prior art further teaches using a cascaded design to reach the appropriate voltage output level of a charge pump circuit. For example, to generate a 2.5 output voltage level, a DC voltage generator system can be implemented with a two-stage cascaded pump circuit; a pump circuit is connected in the first stage to generate an intermediate voltage supply, which in turn feeds another pump circuit in the second stage to generate the 2.5 output voltage level. However, such a cascaded design is prone to the ripple effect, i.e., the voltage output drops below a low limit level and rises above a high limit level due to delays in signaling the pump circuit to power on or off. Further, the prior art does not teach the use of a cascaded design when the supply voltage of the DC voltage generator system is at or near one-volt.

Accordingly, a need exists for a DC voltage generator system capable of operating at low-power, and especially, when the supply voltage is at or near one-volt, e.g., in the range of 0.5 to 1.7 volts, while maintaining operating efficiency of the charge pump circuits, in order to reduce power consumption, maximize system performance, minimize the surface area required in implementing the memory unit, and maintain the integrity of the data stored within the memory unit.

A need further exists for a DC voltage generator system capable of operating at low-power, and especially, when the supply voltage is at or near one-volt, and includes at least one intermediate device between two circuits having different operating or threshold voltages.

Further, a need exists for a DC voltage generator system capable of operating at low-power, and especially, when the supply voltage is at or near one-volt, and includes a cascaded design which is not substantially prone to the ripple effect.

SUMMARY

An objective of the present invention is to provide a DC voltage generator system for a semiconductor chip, such as a memory, microprocessor, or logic, where the DC voltage generator can be operated at low-voltage and low-power.

Another objective of the present invention is to provide a DC voltage generator system capable of operating at low-power, and especially, when the supply voltage is at or near one-volt, and includes at least one intermediate device between two circuits having different threshold voltages.

Further, another objective of the present invention is to provide a DC voltage generator system capable of operating at low-power, and especially, when the supply voltage is at or near one-volt, and includes a cascaded design which is not substantially prone to the ripple effect.

Further still, another objective of the present invention is to provide a DC voltage generator system for a memory unit, such as an eDRAM memory unit or CPU chip, for activating charge pump circuits therein to refresh data cells of the memory unit, while maintaining operating efficiency of the charge pump circuits, maximizing system performance, minimizing the surface area required in implementing the memory unit, and maintaining the integrity of the data stored within the memory unit.

Still, another objective of the present invention is to implement the low-power DC voltage generator system within a battery-operated device having at least one memory unit. The low-power DC voltage generator system extends battery lifetime and data retention time of the cells of the at least one memory unit.

Accordingly, the present invention provides a low-power DC voltage generator system having two negative voltage pump circuits for generating voltages for operating the Vwl and Vbb charge pump circuits, a reference generator for generating a reference voltage, and a two-stage cascaded positive pump system having a first stage pump circuit and a second stage pump circuit. The first stage converts a supply voltage to a higher voltage level, e.g., one volt to 1.5 volts, to be used for I/O drivers, and the second stage converts the output voltage from the first stage to a higher voltage level, e.g., from 1.5 volts to about 2.5 volts, for operating the Vpp charge pump circuit or boost wordline charge pump circuit. The DC voltage generator system further includes a micro pump circuit for providing a voltage level which is greater than one-volt to be used as reference voltages, even when an operating voltage of the DC voltage generator system is at or near one-volt. A one-volt negative voltage pump circuit is also included for pumping the voltages of at least one corresponding charge pump circuit, even when an operating voltage of the DC generator system is at or near one-volt.

The DC voltage generator system is specifically designed to be implemented within battery-operated devices having at least one memory unit. The low-power consumption feature of the DC voltage generator system extends battery lifetime and data retention time of the cells of the at least one memory unit.

DETAILED DESCRIPTION OF THE INVENTION

The present invention provides a low-voltage, low-power DC voltage generator system which is capable of operating when the supply voltage is at or near one-volt, and therefore decreases power consumption. The low-power DC voltage generator system of the present invention is designed to be implemented within an integrated circuit of a semiconductor chip, such as an eDRAM memory unit, and includes at least a bandgap reference generator, a temperature sensor, a cascaded positive voltage generator, a micro pump circuit, and a negative voltage pump circuit generator. Preferred bandgap reference generators and temperature sensors which can be implemented in the present invention are bandgap reference generators and temperature sensors as known in the art.

Figure 1:
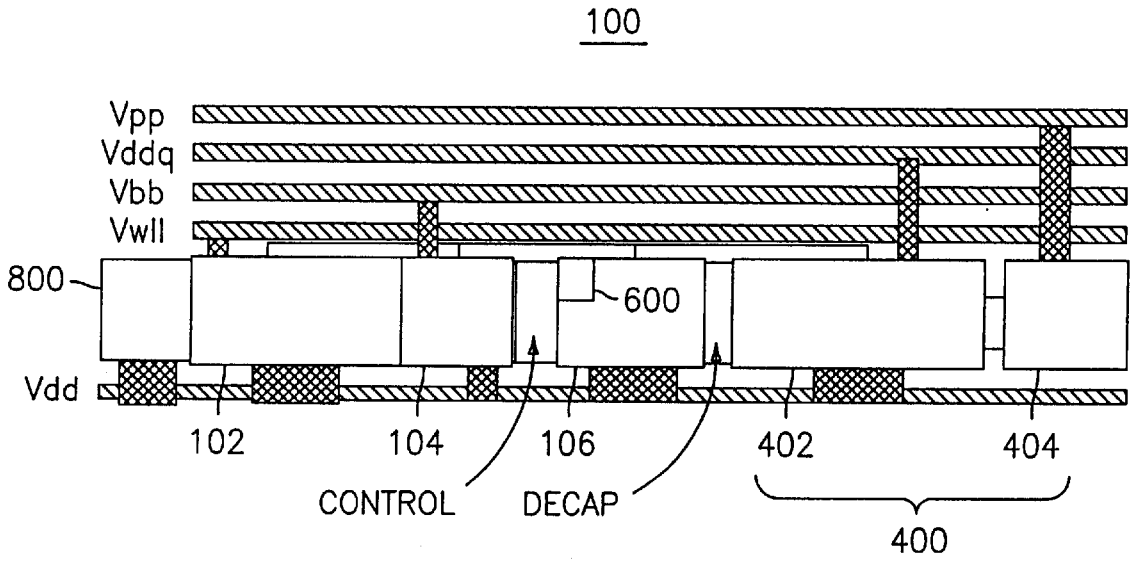
FIG. 1 is a chip layout view of the DC voltage generator system according to the present invention.

A chip layout view of the DC voltage generator according to the present invention is shown by FIG. 1 and designated generally by reference numeral 100. The DC voltage generator system 100 includes two negative voltage pump circuits 102, 104 for generating voltages for operating the negative wordline, Vwl, and substrate bias, Vbb, charge pump circuits, respectively, a reference generator 106 for generating a reference voltage, and a two-stage cascaded positive pump system 400 (FIG. 4) having a first stage pump circuit 402 and a second stage pump circuit 404. The first stage 402 converts a supply voltage to a higher voltage level, e.g., one volt to 1.5 volts, to be used for I/O drivers, and the second stage 404 converts the output voltage from the first stage 402 to a higher voltage level, e.g., from 1.5 volts to about 2.5 volts, for operating the Vpp charge pump circuit or boost wordline charge pump circuit.

The DC voltage generator system 100 further includes a micro pump circuit 600 (FIG. 6) for providing a voltage level which is greater than one-volt to inside the reference generator 106, even when an operating or supply voltage of the DC voltage generator system 100 is at or near one-volt. A one-volt negative voltage pump circuit 800 (FIG. 8) is used for generating the voltages of at least one corresponding charge pump circuit 102, 104, even when an operating voltage of the DC generator system 100 is at or near one-volt.

The DC voltage generator system 100 also includes control circuitry CONTROL and, an on-chip decoupling capacitor DECAP. The control circuitry CONTROL controls the voltage levels of the various devices of the system 100, such as a limiter, selector, decoder, differential amplifier, etc. The on-chip decoupling capacitor DECAP is a high-density capacitor which can be fabricated using deep-trench capacitors or stack capacitors. The decoupling capacitor DECAP is used to decouple noise from the generated voltage levels.

Figure 2A:
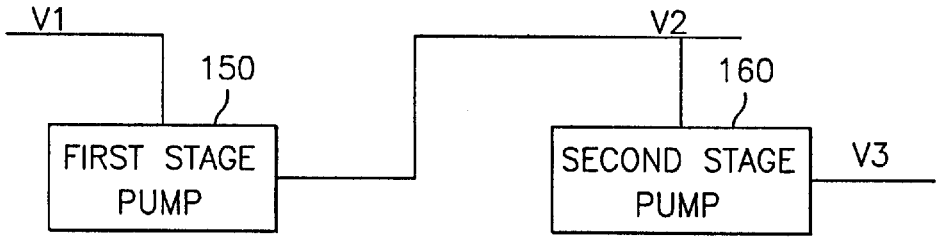
FIG. 2A (PRIOR ART)
FIG. 2A is a prior art cascaded pump system for a DC voltage generator system.
Figure 2B:
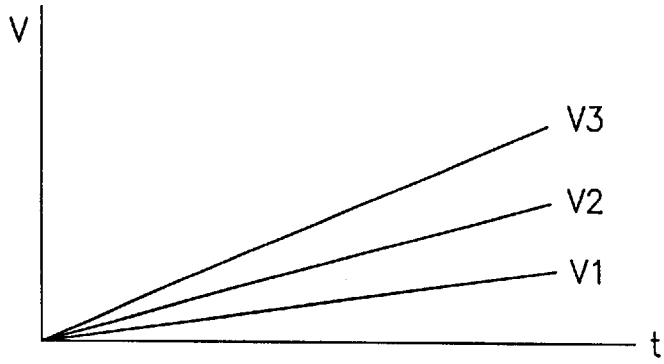
FIG. 2B (PRIOR ART)
FIG. 2B is a chart showing voltage versus time for the cascaded pump system of FIG. 2A.

The various components of the DC voltage generator system 100 are capable of operating when the supply voltage, Vdd, is at or near one-volt, for example, in the range of 0.7 to 1.5 volts, A. Cascaded Positive Voltage Pump System With reference to FIG. 2A, there is shown a conventional cascaded pump system where voltage is pumped or converted up from V1 to V2 via a first stage pump circuit 150 and then converted up from V2 to V3 via a second stage pump circuit 160. As shown by FIG. 2B, when V1 is ramped up, V2 and V3 are also ramped up accordingly. It has been demonstrated that in order to control the ramp up speed, the pump circuits are linked in a serial structure, or cascaded structure. However, after the pump circuits reach their appropriate voltage levels, they are linked in a parallel structure to gain more power.

Figure 3:
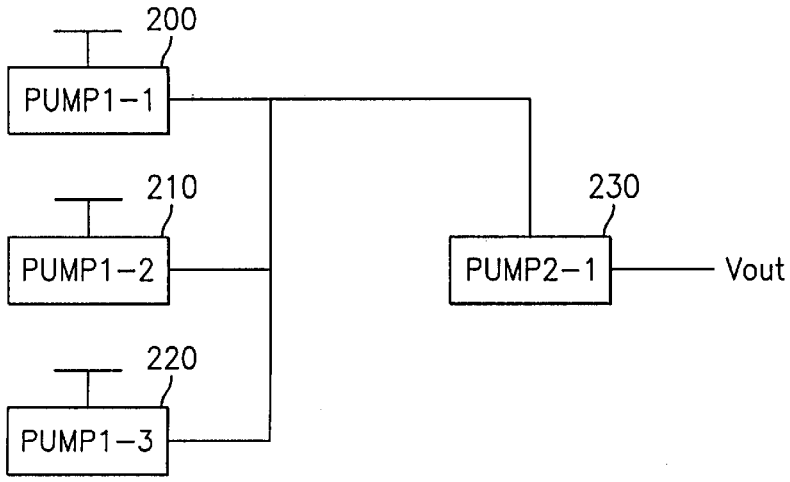
FIG. 3 is a block diagram of a cascaded pump system for implementing a DC voltage generator system according to the present invention.

With reference to FIG. 3, there is shown a three-to-one cascaded positive pump system, where pump circuits 200, 210, 220 are arranged in parallel in the first stage, while pump circuit 230 of the second stage is arranged in series with the first stage pump circuits 200, 210, 220. The voltage output from the first stage pump circuits 200, 210, 220 is fed into the input of the second stage pump circuit 230 to result in the final voltage level of Vout. It has been determined that the cascaded pump system increases the overall pump circuit efficiency by approximately 50%.

Figure 4:
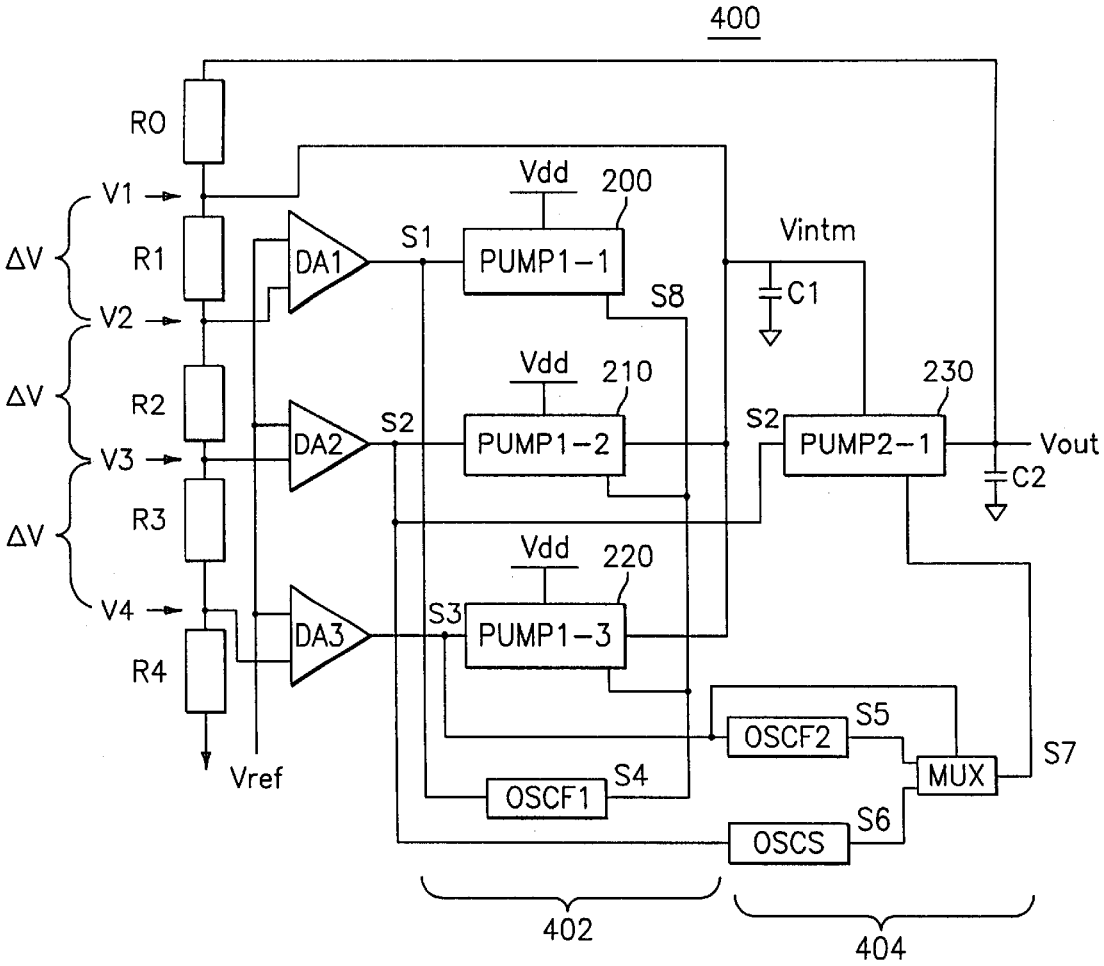
FIG. 4 is a schematic diagram showing the cascaded positive pump system of the present invention.

FIG. 4 illustrates a schematic diagram of a modified three-to-one cascaded positive pump system, designated by reference numeral 300, for outputting a substantially smooth pump output voltage, Vout. In general, if the cascaded positive pump system 300 is not properly designed, the output voltage, Vout, can be very wavy, due to the ripple or fluctuation effect. The ripple effect is caused by voltage overshoot and undershoot, due to a delayed feedback control.

For example, when a pulse of current is drawn from the pump output of the second stage pump circuit 230, if the pump circuit 230 and a corresponding decoupling capacitor C2 cannot supply sufficient current, a voltage drop is seen at the output voltage. The voltage drop triggers a pump limiter, which is formed by a resistor divider and multiple differential amplifiers, to activate the pump circuit 230 to turn on and supply the current. Since, there is a delay for this to occur, the voltage level at the output will continue to drop, even lower than the low limit level, before it starts to ramp up. This is called the undershooting effect.

When the current is supplied from the pump circuit 230, it will not only meet the circuit demand, but also charge up the decoupling capacitor C2, and eventually, the output voltage, Vout, will start to rise, and hit the high limit level. When this occurs, a clock signal s2 is sent to the pump circuit 230 to trigger it off. However, also because of a delay, by the time the pump circuit 230 is off, the voltage level at the output of the pump circuit 230 has already exceeded the high limit level. This is called the overshooting effect.

The continued process of undershooting and then overshooting of the cascaded positive pump system 300 determines the pump fluctuation level. It has been demonstrated that even if the pump system 300 is designed with over capacity, such as having a high pumping speed to reduce delays, the fluctuation is not adequately reduced. If the over capacity design is equipped with an oversized decoupling capacitor, the fluctuation effect may be suppressed. However, fabrication and operating costs may increase, since more surface area and more power is required to fabricate and operate the cascaded positive pump system 300.

With continued reference to FIG. 4, the three-to-one cascaded positive pump system 300 will now be described with emphasis on how the system 300 is designed so that it is not substantially prone to the ripple or fluctuation effect. The pump system 300 includes a series of resistors R0, R1, R2, R3, R4 which are connected to the output voltage, Vout, and three differential amplifiers (DA) DA1, DA2, DA3 having an output connected to an input of a corresponding first stage pump circuit.

One of the two inputs of the DA converters DA1, DA2, DA3 is connected to a reference voltage, Vref, generated by the reference generator 106. As shown by FIG. 4, resistors R0, R1 are connected to the output of pump circuit 200, resistors R1, R2 are connected to an input of DA converter DA1, resistors R2, R3 are connected to an input of DA converter DA2, and resistors R3, R4 are connected to an input of DA converter DA3.

Resistor R1, R2, R3 have identical resistance values and are properly sized so that the voltage drop across each resistor R1, R2, R3 is controlled as $\Delta v$, i.e., preferably, in the range of 50 mV to 100 mV. When the output voltage, Vout, is ramping up, the voltage levels along the resistor divider have the following relationship: V1>V2>V3>V4. Therefore, when the output voltage, Vout, is ramping up, the first differential amplifier DA1 is turned off to turn off pump circuit 200, since V2 will exceed the reference voltage, Vref, first. The output voltage, Vout, continues to rise and the second differential amplifier DA2 turns off to turn off pump circuit 210, and finally, the third differential amplifier DA3 turns off to turn off pump circuit 220.

The first stage pump circuits 200, 210, 220 are powered with a faster oscillator OSCF1 via clock input signal s4, and the second stage pump circuit 230 is powered with either a faster or slower oscillator, i.e., either OSCF2 or OSCS, depending on the situation as described below, via another clock input signal s7. The first and second stage pump circuits are conventional pump circuits as known in the art.

In other words, in the first stage 402, pump circuit 200 will be directed to stop when its output voltage, Vintm, i.e., the intermediate voltage, reaches Vintm+2Δv by clock signal s1. Pump circuit 210 will be directed not to stop until the output reaches Vintm+1Δv by clock signal s2. Pump circuit 220 is stopped when the output reaches Vintm by clock signal s3. Vintm is the supply voltage of the second stage pump circuit 230.

In the second stage 404, pump circuit 230 is powered by the faster oscillator OSCF2 by providing clock signal s5 to multiplexer MUX, in order for the pump circuit 230 to pump with a high speed when the voltage output, Vout, is below the target level. Pump circuit 230 is powered by the slower oscillator OSCS by providing clock signal s6 to the multiplexer MUX when the output voltage, Vout, reaches the appropriate level, but not Vout+Δv. When the output voltage, Vout, is higher than Vout+Δv, both oscillators, OSCF2 and OSCS, are shut off. Hence, pump circuit 230 is also shut off.

The cascaded positive pump system 300 is designed to over-pump, i.e., to shut off pump circuits 200, 210 when the output voltage reaches Vintm+2Δv and Vintm+Δv, respectively, and to shut off the pump circuit 230 when the output voltage, Vout, is higher than Vout+Δv, for charging up an interim capacitor C1 which is used for the second stage pump circuit 230 and for charging up the decoupling capacitor C2.

Figure 5A:
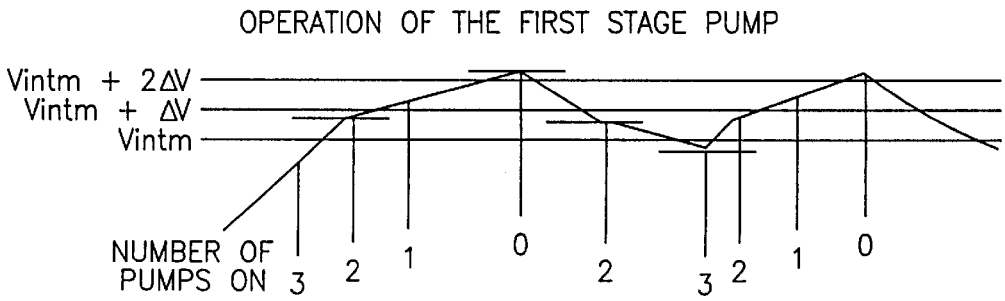
FIG. 5A is a chart illustrating operation of a first stage pump of the cascaded positive pump system of FIG. 4.
Figure 5B:
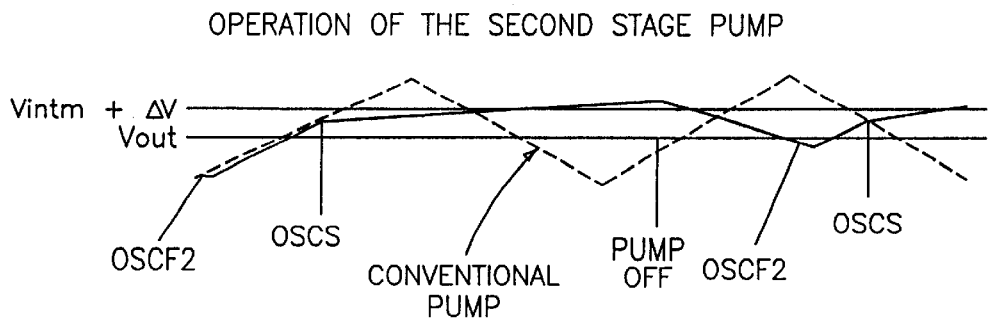
FIG. 5B is a chart illustrating operation of a second stage pump of the cascaded positive pump system of FIG. 4.

The operation of the first and second stages 402, 404 is illustrated by FIGS. 5A and 5B, respectively. For the first stage 402, when Vintm is below target, all three pump circuits 200, 210, 220 are powered by the high speed oscillator OSCF1 and, consequently are on. Therefore, a high pump rate with a steep slope is obtained. When the first limit, i.e., Vintm, is reached, an overshoot situation occurs; pump circuit 200 turns off, while pump circuits 210, 220 continue to operate. When the second limit, i.e., Vintm+Δv, is reached, pump circuit 210 turns off, while only pump circuit 220 continues to operate. Since, pumping power at this moment is reduced, the slope of the ramp is lower. When the final limit, i.e., Vintm+2Δv, is reached, all the first stage pump circuits 200, 210, 220 turn off. Accordingly, the cascaded system of FIG. 4, causes the fluctuation of the Vintm voltage to be less as compared to simultaneously turning on and off all of the first stage pump circuits 200, 210, 220.

For the second stage 404, since only pump circuit 230 is present, a variable speed design is employed to smooth the output voltage fluctuation. When the voltage is below the output voltage, the pump circuit 230 pumps with a high speed. When the voltage passes the output voltage, the speed of the pump circuit 230 is reduced until it reaches the second limit Vout+Δv. At that time, the pump circuit 230 of the second stage 404 is shut off This design results in better control of the output voltage than only having one speed and one voltage limit for the pump circuit 230 as in the conventional design. The output voltage of the conventional design is shown by the broken line in FIG. 5B.

B. Micro Pump Circuit

Figure 6:
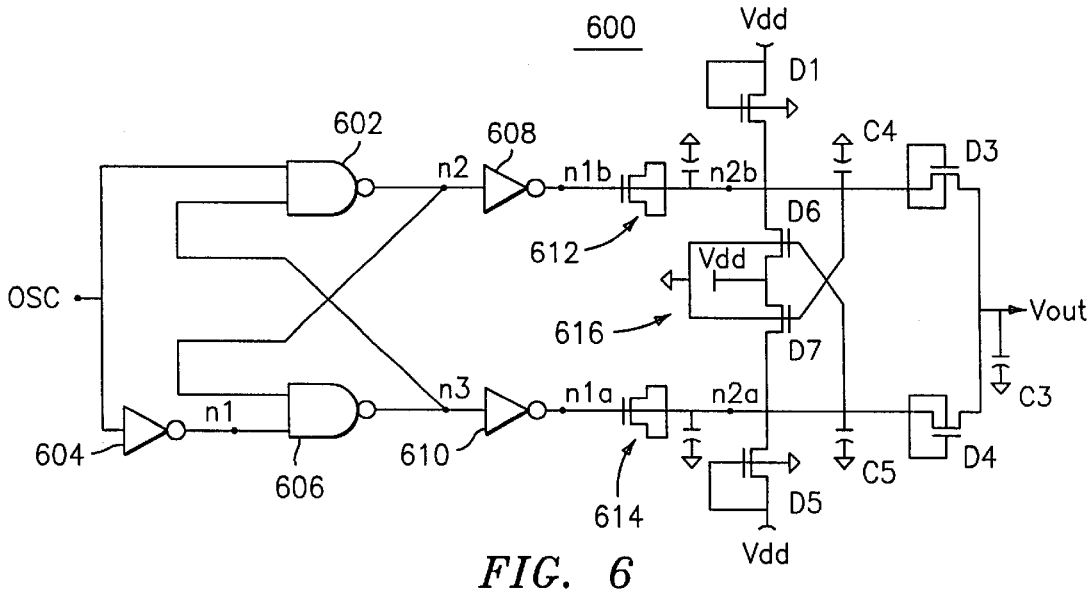
FIG. 6 is a schematic diagram of a micro pump circuit for implementing within the DC voltage generator system of the present invention.

The micro pump circuit of the DC voltage generator system 100 is shown by FIG. 6 and designated by reference numeral 600. The circuit 600 is designed to be small to take up as little surface area of the semiconductor chip as possible and to have the flexibility of being able to be placed almost anywhere on the chip. Further, the micro pump circuit's small design allows it to be placed closer to other circuits of the chip than prior art bulky pump circuits. Moreover, due to its small design, a cluster of micro pump circuits can be fitted into almost any residual area of the chip and are configured for being stacked in parallel or serial with one other micro pump circuits. Preferably, the micro pump circuit 600 has a two-dimensional size of approximately 40 um×60 um.

The function of the micro pump circuit 600 is to provide a voltage level which is greater than one volt for generating reference voltages, even when the operating voltage, Vdd, of the DC voltage generator is at or near one-volt. If two or more of the micro pump circuits 600 are linked in serial to form a micro pump serial configuration, then a higher output voltage can be supplied to the reference generator 106. If two or more of the micro pump circuits 600 are linked in parallel to form a micro pump parallel configuration, then a higher current can be supplied to the reference generator 106.

With reference to FIG. 6, the micro pump circuit 600 is symmetrical in design. A clock signal OSC is alternatively fed to a NAND gate 602 and an inverter 604. The output of the inverter 604 forms a node n1 which connects the inverter 604 to a NAND gate 606. The output of NAND gate 602 forms a node n2 which connects the NAND gate 602 to the NAND gate 606. The output of NAND gate 606 also forms a node n3 which connects the NAND gate 606 to the NAND gate 602. A decoupling capacitor C3 is used in conjunction with two nMOS output diodes D3, D4 to pump the supply voltage, Vdd, to a higher output voltage level, Vout.

The logic part of the micro pump circuit 600 occupies a very small area as compared to the area occupied by the boost or planar-type capacitors 612, 614. Accordingly, it is contemplated to use a deep trench capacitor for the boost capacitor, to significantly reduce the overall area occupied by the circuit 600 by approximately 75%. If a deep trench capacitor is used instead of a boost capacitor, the micro pump circuit 600 has a two-dimensional size of approximately 10 um×15 um.

The pumping cycle of the micro pump circuit 600 includes first precharging the n2*b* node through an nMOS diode D1 having an anode connected to the supply voltage, Vdd. During the first half of the pumping cycle, the voltage applied to node n1*b* causes the voltage at node n2*b* to be boosted by boost capacitor 612. The voltage at node n2*b* is fed to Vout through the upper nMOS output diode D3. The boost capacitor 612 is an nMOS device having a gate tied to node n1*b* and a drain, source and body tied together and connected to node n2*b*. At the same time while the voltage at node n2*b* is boosted, node n2*c* is precharged. During the second half of the pumping cycle, the voltage applied to node n1*a* causes the voltage at node n2*c* to be boosted by boost capacitor 614. The voltage at node n2*c* is fed to Vout through the lower nMOS output diode D4.

The pumping speed of the micro pump circuit 600 can be controlled by controlling the clock signal OSC. If the clock signal OSC is high, then the pumping speed of the micro pump circuit 600 is high. If the clock signal OSC is low, then the pumping speed of the micro pump circuit 600 is low.

Diodes D1, D5 are used to precharge nodes n2*b* and n2*c*, respectively. Diodes D6, D7 and boost capacitors C4, C5 are used to cross-boost nodes n2*b* and n2*c*, respectively.

In order to reduce the reverse current from Vout to Vdd through the reversed-biased diodes D1, D3, D4, D5, D6, D7 during standby, especially if the micro pump circuit 600 is intended to be operated at a lower frequency, one can use high threshold voltage devices to form the reversed-biased diodes. For example, if the micro pump circuit 600 is redesigned to include an active pump and a standby pump, one can use high threshold voltage nMOS diodes for the standby pump which use a low oscillator frequency, while using low threshold voltage nMOS diodes for the active pump which use a high oscillator frequency.

The uniqueness of the micro pump circuit 600 is its small size and low-power consumption, which make it an ideal circuit for generating a greater than one-volt DC reference voltage.

Figure 7:
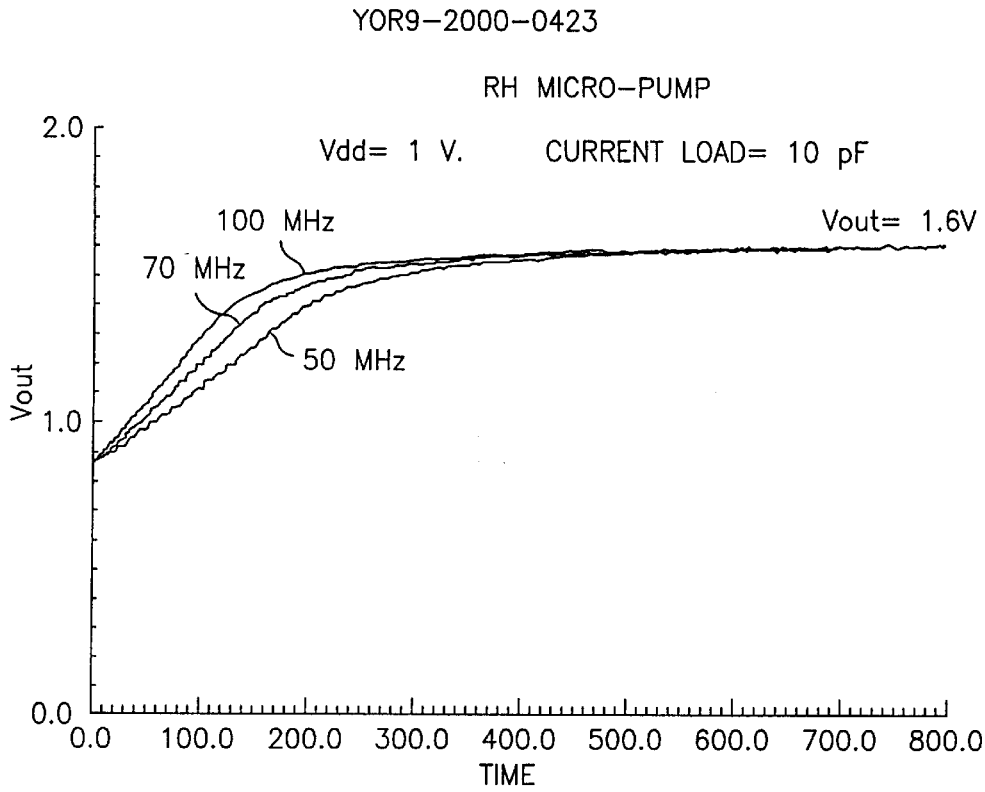
FIG. 7 is a chart showing voltage versus time for the micro pump circuit of FIG. 6.

The waveforms illustrated by FIG. 7 show the output voltage, Vout, from the micro pump circuit 600 running with different oscillator frequencies. It is apparent from FIG. 7 that the micro pump circuit 600 of the DC voltage generator system 100 can cause the output voltage, Vout, to reach 1.6 volts with a supply voltage, Vdd, of one volt and with a current load about 5 ua.

C. One-volt Negative Voltage Pump Circuit

Figure 8:
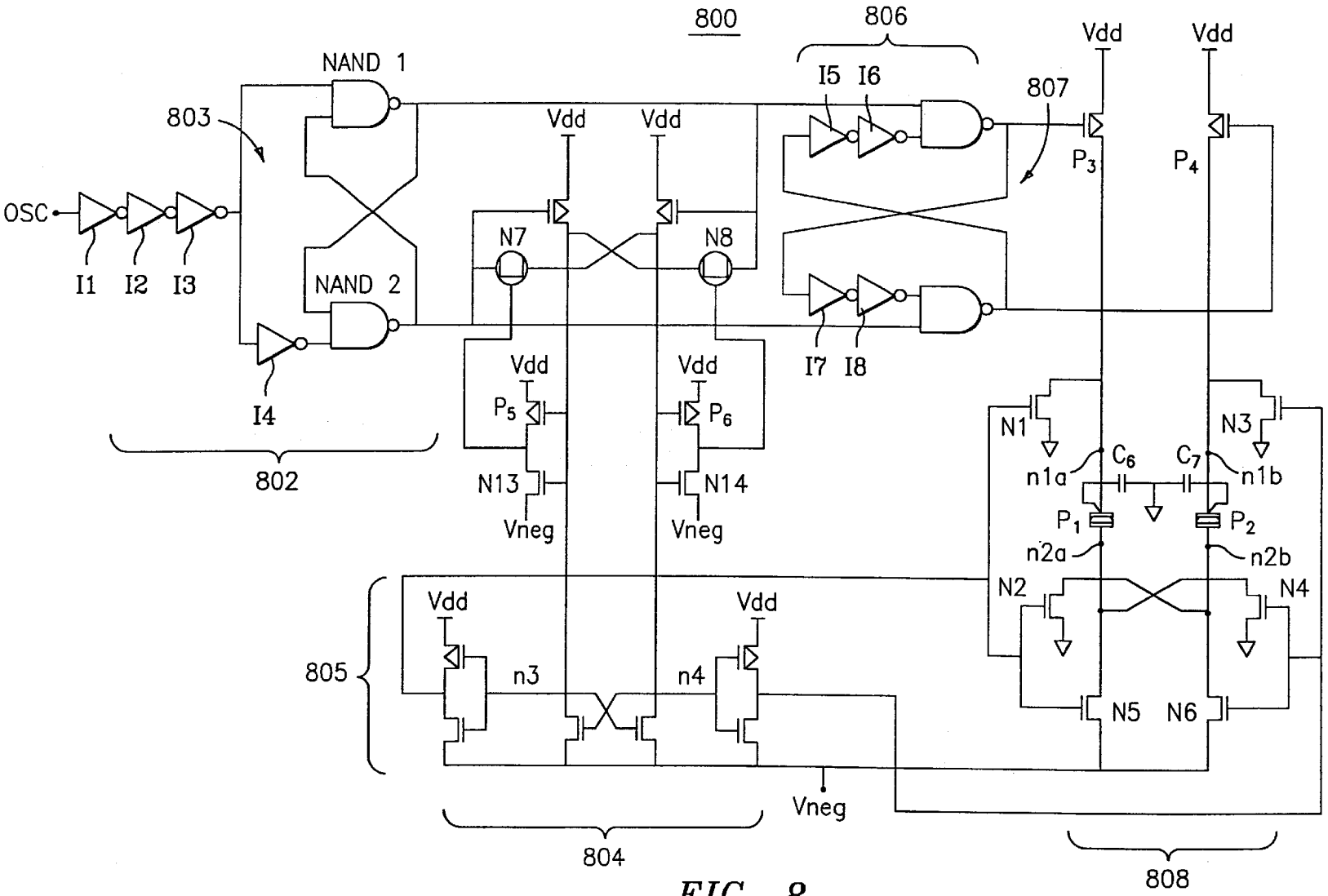
FIG. 8 is a schematic diagram of a negative voltage pump circuit for implementing within the DC voltage generator system of the present invention.

The negative voltage pump circuit of the low-power DC voltage generator system 100 of the present invention is schematically shown by FIG. 8 and designated generally by reference numeral 800. The pump circuit 800 generally includes a clock driver circuit 802, a level shifting circuit 804, a pump driver circuit 806, and a charge pump circuit 808. The clock driver circuit 802 transmits a clock signal derived from a clock signal OSC to the level shifting circuit 804. The level shifting circuit 804 converts the transmitted low clock signal from ground level to a negative voltage level, "Vneg". The pump driver circuit 806 then uses the clock signals from the level shifting circuit 804, to pump the voltages via the charge pump circuit 808 from ground to a negative (or Vneg) voltage level, even when the supply or operating voltage, Vdd, of the DC voltage generator system 100 is at or near one-volt.

The clock driver circuit 802 includes four inverter buffers I1, I2, I3, I4 and a NAND-type cross-over complementary clock driving circuit 803 to generate non-overlapping clocks, as known in the art, for the level shifting circuit 804. The pump driver circuit 806 includes four inverter buffers I5, I6, I7, I8 and a NAND-type cross-over complementary clock driving circuit 807, as known in the art, to generate non-overlapping clocks for the charge pump circuit 808.

The charge pump circuit 808 includes two pMOS boost capacitors P1, P2. Preferably, the capacitance of each capacitor P1, P2 is approximately 40 pF. The boost capacitors P1, P2 are pMOS devices built on a pwell. The gates of capacitors P1, P2 are connected to nodes n2*a*, n2*b*, respectively. The source, drain and body of the capacitors P1, P2 are tied together and connected to nodes n1*a*, n1*b*, respectively. The charge pump circuit 808 is formed by two pull-up pMOS devices P3–P4 fabricated on an isolated nwell. The charge pump circuit 808 further includes six nMOS devices N1–N6.

Devices N1, N2 are the discharge devices across the boost capacitor P1; devices N3, N4 are the discharge devices across the boost capacitor P2. While devices N5, N6 are output diodes for the charge pump circuit 808. Capacitors C6 and C7 are parasitic capacitors for boost capacitors P1, P2, respectively, for simulation purposes.

During the first half of a charge pump cycle, node n1*a*, which is located between pull-up device P3 and the boost capacitor P1, is charged to Vdd through pMOS device P3. At the same time, node n2*a*, which is located between output diode device N5 and boost capacitor P1, is discharged to ground through a discharge device N4. When the first half of the charge pump cycle is over, both pull-up device P3 and discharge device N4 are turned off.

During the second half of the charge pump cycle, nMOS device N1 is turned on and node n1*a* is discharged from Vdd to ground through the discharge device N1. At this moment, node n2*a* will couple from ground to a negative level through the boost capacitor P1. This turns on the output diode device N5 to pump charges from Vneg to node n2*a* and dump the charge to ground through discharge device N4.

Similarly, the other half of the charge pump circuit 808 will follow the same sequence to pump the charge at the Vneg node to ground through discharge device N2.

With this design configuration for the charge pump circuit 808, when one branch of the circuit 808 is precharging, the other branch of the charge pump circuit 808 is discharging. Therefore, two branches can be used alternatively to pump the charges from Vneg to ground.

It is noted that the boost voltage levels at nodes n2*a* and n2*b* must be carefully selected. If the voltage levels are too negative, then there could be excessive charge loss due to forward bias of the pn junction of the output nMOS devices N5, N6. On the other hand, if the voltage levels are not negative enough, then the pumping efficiency of the charge pump circuit 808 is degraded.

It is preferred that the boost voltage level at nodes n2*a* and n2*b* be kept at approximately 200 mV below Vneg. By properly selecting the size of pMOS devices P3, P4, one can determine the boost voltage level at these nodes.

Further, it is also preferred that the threshold voltage of all the devices used to fabricate the negative voltage pump circuit 800 is below 0.5 volt, and preferably, in the range from 0.3 to 0.45 volt. If the threshold voltage is above 0.6 volt, the pump efficiency of the circuit 800 begins to degrade. Further, it is also preferred that deep trench capacitors are used instead of the boost capacitors P1, P2 to reduce the surface area occupied by the negative voltage pump circuit 800 by approximately 75%.

The level shifting circuit 804 is designed with a pair of extra transfer nMOS devices N7, N8 and a pair of inverters. One inverter is formed by devices P5 and N13 and the other inverter is formed by devices P6 and N14. This design configuration significantly improves the switching speed of the level shifting circuit 804, especially when the supply voltage, Vdd, drops below one-volt, as compared to prior art level shifting circuits which typically include only the bottom portion 805 of the inventive level shifting circuit 804.

The switching speed is significantly improved because during the first half of the charge pump cycle the first branch of the level shifting circuit 804, or node n3, is pulled up to Vdd by device N8. During the second half of the charge pump cycle, the other branch, or node n4, gets charged up from Vneg to Vdd through device N7. The quick pull-up path, for example, for node n3, is through transfer nMOS device N8 to the supply voltage, Vdd, through pull-up of the NAND_1 device.

Likewise, the quick pull-up path for node n4 is through transfer nMOS device N7 to the supply voltage, Vdd, through pull-up of the NAND_2 device. The faster these nodes can be pulled up, the faster the level shifting circuit 804 can switch. Consequently, minimal feed-through current results.

The negative voltage pump circuit 800 solves the problem of the threshold voltage of prior art charge pump circuits not being able to be scaled at the same rate as the supply voltage, Vdd. The circuit 800 provides at least one intermediate device, i.e., the level shifting circuit 804, which can be implemented with variable threshold voltage. When the charge pump circuit 808 is activated, the threshold voltage of the level shifting circuit 804 is decreased, in order to improve the efficiency of the charge pump circuit 808. When the charge pump circuit 808 reaches the required output voltage, i.e., the charge pump circuit has been adequately scaled to output the required voltage level, the charge pump circuit 808 is deactivated and the threshold voltage of the level shifting circuit 804 is increased to reduce the DC standby current.

Figure 9:
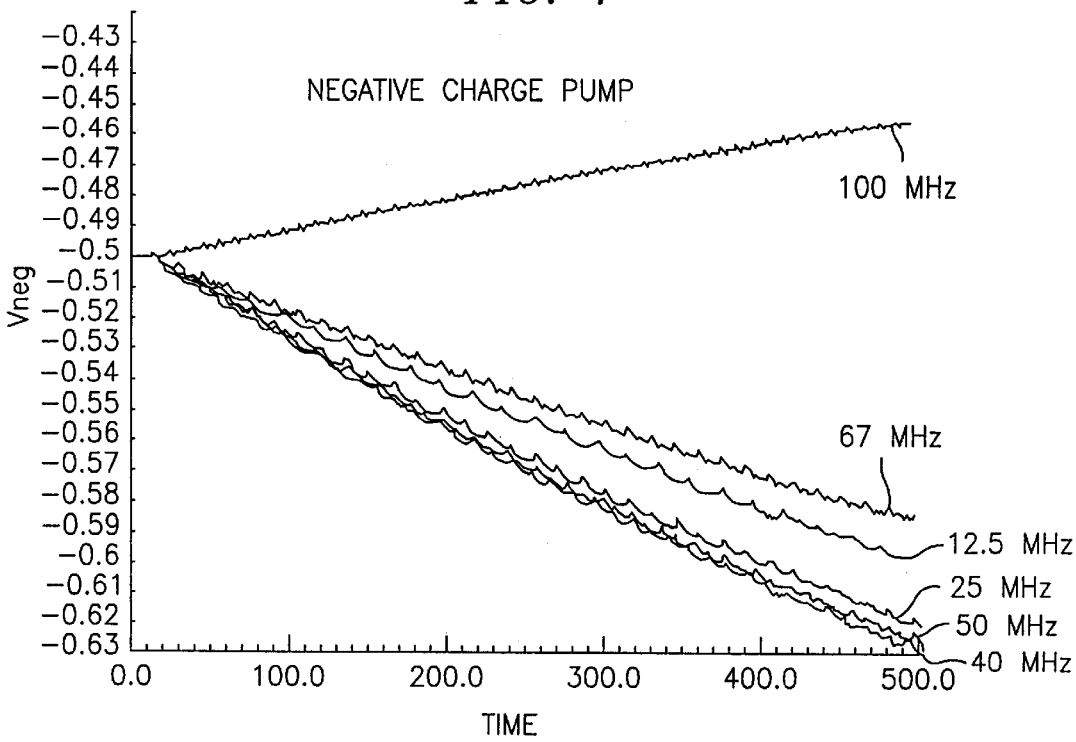
FIG. 9 is a chart showing voltage versus time for the negative voltage pump circuit of FIG. 8.

With reference to FIG. 9, there are shown waveforms indicating that the negative voltage pump circuit 800 has an optimum operating frequency in the 25 to 50 MHZ. The level shifting and charge pump circuits 804, 808 cannot operate at a high switching speed, e.g., 100 MHz.

The low-voltage, low-power DC voltage generator system 100 of the present invention can be added to most semiconductor chips to be able to generate a high voltage level, even when the power supply voltage is at or near one-volt, e.g., in the range of 0.5 to 1.7 volts. The DC voltage generator system 100 described herein does not consume a great amount of power and operates efficiently, even when the supply voltage is at or near one-volt. Additionally, the DC voltage generator system 100 is designed for implementation within battery-operated devices having at least one memory unit. The low-power DC voltage generator system 100 extends battery lifetime.

What has been described herein is merely illustrative of the application of the principles of the present invention. For example, the functions described above and implemented as the best mode for operating the present invention are for illustration purposes only. Other arrangements and methods may be implemented by those skilled in the art without departing from the scope and spirit of this invention.

We claim:

1. A DC voltage generator system for an integrated circuit, said generator system being operated by a supply voltage at or near one-volt and comprising:

a negative voltage pump circuit comprising:

first means for receiving a clock signal and alternatively outputting a high portion of said clock signal from a first pair of outputs;

first means for switching between one of two inputs for alternatively receiving said high portion of said clock signal from said first pair of outputs and outputting an intermediate voltage and a first logic high output from one of two outputs, where each of said one of two inputs includes a switch connected in series with an inverter;

second means for alternatively receiving said logic high output from said one of two outputs and outputting a second logic high output from a second pair of outputs; and second means for switching between one of two inputs for alternatively receiving said second logic high output from said second pair of outputs and outputting a negative output voltage.

2. The generator system according to claim 1, wherein said first means for receiving said clock signal and said second means for alternatively receiving said logic high output include NAND-type cross-over complementary clock driving circuits for generating non-overlapping clock signals.

3. The generator system according to claim 1, wherein said inverter of each of said one of two inputs includes an nMOS and a pMOS transistor.

4. The generator system according to claim, 1, wherein said second means for switching comprises:

a first pull-up device connected to one of said second pair of outputs, the supply voltage, and a first boost capacitor;

a second pull-up device connected to another of said second pair of outputs, the supply voltage, and a second boost capacitor;

a first pair of discharge devices for the first boost capacitor;

a second pair of discharge devices for the second boost capacitor;

a first output diode connected to the first boost capacitor, the first pair of discharge devices, and one of the second pair of discharge devices; and a second output diode connected to the second boost capacitor, the second pair of discharge devices, and one of the first pair of discharge devices.

5. The generator system according to claim 4, further comprising a pair of charge capacitors connected in series with said first and second boost capacitors.

6. The generator system according to claim 1, wherein said intermediate voltage is a negative voltage.

7. The generator system according to claim 1, wherein said clock signal has an frequency in the range from 25 MHz to 50 MHz.

8. The generator system according to claim 1, wherein said first and second means for switching include low-threshold devices having threshold voltages less than 0.5 volt.

9. The generator system according to claim 8, wherein said threshold voltages are in the range from 0.3 to 0.45 volt.

10. The generator system according to claim 1, further comprising means for generating an operating voltage for a negative wordline charge pump circuit of at least one memory unit of said integrated circuit, means for generating an operating voltage for a substrate bias charge pump circuit of at least one memory unit of said integrated circuit, and means for generating an operating voltage for a boost wordline charge pump circuit of at least one memory unit of said integrated circuit, wherein said means for generating said operating voltage for said negative wordline charge pump circuit, said means for generating said operating voltage for said substrate bias charge pump circuit, and said means for generating said operating voltage for said boost wordline charge pump circuit are operated by said supply voltage.

11. The generator system according to claim 1, wherein said first means for receiving said clock signal and said second means for receiving said clock signal include NAND-type cross-over complementary clock driving circuits for generating non-overlapping clock signals.

12. The generator system according to claim 1, further comprising a reference generator for generating and providing a reference voltage being operated by said supply voltage.

13. The generator system according to claim 1, further comprising a cascaded pump arrangement including a first stage having at least two pump circuits and a second stage having at least one pump circuit, said cascaded pump arrangement being operated by said supply voltage.

14. The generator system according to claim 1, further comprising a pump circuit being operated by said supply voltage for outputting an output voltage via an output node, where said output voltage is greater than said supply voltage.

15. The generator system according to claim 1, wherein said supply voltage is in the range of 0.7 to 1.5 volts.

16. A DC voltage pump circuit in a DC voltage generator system for an integrated circuit, said generator system being operated by a supply voltage at or near one-volt and said DC voltage pump circuit being operated by said supply voltage for outputting an output voltage, comprising:

means for receiving a clock signal;

means for alternatively feeding said clock signal to a first logic circuit or a second logic circuit;

means for alternatively receiving said clock signal from said first logic circuit by a first circuit or from said second logic circuit by a second circuit to increase the voltage level at a corresponding output node of said first or second circuit;

means for increasing said output voltage by alternatively feeding said increased voltage level from said corresponding output node of said first or second circuit to said output node, where said output voltage is greater than said supply voltage;

means for generating an operating voltage for a negative wordline charge pump circuit of at least one memory unit of said integrated circuit;

means for generating an operating voltage for a substrate bias charge pump circuit of at least one memory unit of said integrated circuit; and means for generating an operating voltage for a boost wordline charge pump circuit of at least one memory unit of said integrated circuit, wherein said means for generating said operating voltage for said negative wordline charge pump circuit, said means for generating said operating voltage for said substrate bias charge pump circuit, and said means for generating said operating voltage for said boost wordline charge pump circuit are operated by said supply voltage.

17. A DC voltage pump circuit in a DC voltage generator system for an integrated circuit, said generator system being operated by a supply voltage at or near one-volt and said DC voltage pump circuit being operated by said supply voltage for outputting an output voltage, comprising:

means for receiving a clock signal;

means for alternatively feeding said clock signal to a first logic circuit or a second logic circuit;

means for alternatively receiving said clock signal from said first logic circuit by a first circuit or from said second logic circuit by a second circuit to increase the voltage level at a corresponding output node of said first or second circuit;

means for increasing said output voltage by alternatively feeding said increased voltage level from said corresponding output node of said first or second circuit to said output node, where said output voltage is greater than said supply voltage; and a negative voltage pump circuit comprising:

first means for receiving a clock signal and alternatively outputting a high portion of said clock signal from a first pair of outputs;

first means for switching between one of two inputs for alternatively receiving said high portion of said clock signal from said first pair of outputs and outputting an intermediate voltage and a first logic high output from one of two outputs;

second means for alternatively receiving said high logic high output from said one of two outputs and outputting a second logic high output from a second pair of outputs; and second means for switching between one of two inputs for alternatively receiving said second logic high output from said second pair of outputs and outputting a negative output voltage.

18. A DC voltage generator system for an integrated circuit, said generator system being operated by a supply voltage at or near one-volt and comprising:

a DC voltage pump circuit operated by said supply voltage for outputting an output voltage, said pump circuit comprising:

means for receiving a clock signal;

means for alternatively feeding said clock signal to a first logic circuit and a second logic circuit, an output of the first logic circuit forming a first node connecting the first logic circuit to the second logic circuit and an output of the second logic circuit forming a second node that connects the second logic circuit to the first logic circuit;

means for alternatively receiving said clock signal from said first logic circuit by a first circuit and from said second logic circuit by a second circuit to increase the voltage level at a corresponding output node of said first or second circuit; and means for increasing said output voltage by alternatively feeding said increased voltage level from said corresponding output node of said first or second circuit to said output node, where said output voltage is greater than said supply voltage.

19. The generator system according to claim 18, wherein said DC voltage pump circuit is configured for stacking in parallel or serial with at least one other DC voltage pump circuit.

20. The generator system according to claim 18, wherein said DC voltage pump circuit is configured to have a two-dimensional size of approximately 40 um×60 um if at least one capacitor of said first and second circuits is a planar-type capacitor or a two-dimensional size of approximately 10 um×15 um if said at least one capacitor of said first and second circuits is a deep-trench capacitor.

21. The generator system according to claim 18, wherein each of said first and second circuits include a boost capacitor for increasing the voltage level at their corresponding output node.

22. The generator system according to claim 18, wherein said means for increasing alternatively feeds said increased voltage level to said output node via a first diode connected to said first circuit or a second diode connected to said second circuit.

23. The generator system according to claim 18, further comprising a capacitor connected to said output node.

24. The generator system according to claim 18, further comprising a reference generator for generating and providing a reference voltage being operated by said supply voltage.

25. The generator system according to claim 18, further comprising a cascaded pump arrangement including a first stage having at least two pump circuits and a second stage having at least one pump circuit, said cascaded pump arrangement being operated by said supply voltage.

26. The generator system according to claim 18, wherein said supply voltage is in the range of 0.7 to 1.5 volts.

* * * * *